US006679735B2

(12) United States Patent
Boemmel et al.

(10) Patent No.: US 6,679,735 B2
(45) Date of Patent: Jan. 20, 2004

(54) ELECTRICAL CONTACT, IN PARTICULAR PIN CONTACT

(75) Inventors: Christian Otto Boemmel, Langen (DE); Rolf Jetter, Darmstadt (DE); Manfred Proff, Dinkelsbuehl (DE)

(73) Assignee: Tyco Electronics AMP GmbH, Bensheim (DE)

( * ) Notice: Subject to any disclaimer, the term of this patent is extended or adjusted under 35 U.S.C. 154(b) by 13 days.

(21) Appl. No.: 10/090,962

(22) Filed: Mar. 4, 2002

(65) Prior Publication Data

US 2002/0182943 A1 Dec. 5, 2002

(30) Foreign Application Priority Data

Mar. 6, 2001 (DE) ..... 101 10 628

(51) Int. Cl.[7] ..... H01R 13/434
(52) U.S. Cl. ..... 439/745
(58) Field of Search ..... 439/745, 746, 439/747, 831, 871, 891

(56) References Cited

U.S. PATENT DOCUMENTS 5,711,687 A * 1/1998 Kuiper-Moore et al. .... 439/745
5,921,821 A * 7/1999 Oka et al. ..... 439/845

FOREIGN PATENT DOCUMENTS

EP 0 762 551 A2 3/1997

* cited by examiner

*Primary Examiner*—Renee Luebke
*Assistant Examiner*—Ann M McCamey

(57) ABSTRACT

The invention relates to an electrical pin contact, (1, 32, 56), having a connecting part (2) and a connector tongue (4) together with a locking part (3, 33, 57). A separate locking spring (14, 34, 58), is provided which is inserted into the locking part (3, 33, 57) perpendicularly to the longitudinal axis of the contact (1, 32, 56). Particularly simple mounting of the locking spring (14, 34, 48) is achieved in that the latter has latching means, which fix the locking spring (14, 34, 58) in position in the locking part (3, 33, 57) through insertion of the locking spring into the locking part (3, 33, 57).

14 Claims, 9 Drawing Sheets

ELECTRICAL CONTACT, IN PARTICULAR PIN CONTACT

FIELD OF THE INVENTION

The invention relates to an electrical contact, in particular according to the precharacterising clause of claim 1.

BACKGROUND OF THE INVENTION

European patent EP 0 762 551 describes a pin contact with a connecting part, a connector tongue, and a locking part. The locking part has a separate locking spring which may be inserted perpendicularly to the pin contact into the locking part. The connector tongue and the locking part are plugged into a mating counterpart and fixed in position therein by the locking spring.

Such pin contacts are conventionally stamped and formed from sheet metal blanks which provides good bending characteristics for cable clamping and which exhibits good electrical conductivity. Such metal is as a rule less usable as a spring material due to a lack of resilience and strength. A compromise material is not capable of fulfilling either requirement optimally.

In EP 0 762 551, a locking spring made from a different suitable material from the pin contact is used. The locking spring is connected with the pin contact using a two part format. Such two-part pin contacts are more expensive to produce than one-part pin contacts. This is because it is necessary to stamp and form two separate components from different materials and to assemble and clamp them together. Assembly and clamping is particularly costly. Moreover, clamping requires more complicated tools, which are not only expensive but also unreliable.

Mounting the locking spring in the direction perpendicular to the connector tongue, as in the European specification recited above, constitutes a considerable simplification relative to the method of sliding one of the two components axially into the other and clamping them together. However, even with the solution proposed in EP 0 762 551, it is still necessary to clamp the two components together to fix the locking spring in the locking part, which is correspondingly costly and time-consuming.

SUMMARY OF THE INVENTION

An object of the invention is to provide a pin contact made stamped and formed from a steel sheet with a separately produced locking spring which is economic to produce and mount.

This object is achieved by the features of claim 1. Because the locking spring has latching means, which fix the locking spring in position through insertion thereof into the locking part, the locking spring may be mounted merely by plugging it into the locking part. Clamping of the components is unnecessary, whereby complicated, time-consuming operations may be eliminated. Because the locking part has openings adapted for insertion and latching of the locking spring, the locking spring mounting process is simplified.

The locking spring may have guide surfaces which contribute to the simplification of locking spring mounting. Latching of the locking spring at its ends makes its connection with the locking part strong.

In order to facilitate mounting a first guide surface, preferably folded at right angles, may be arranged in the area of the rear end of the locking spring on each side thereof. In this way, the locking spring is guided at one end over the entire mounting path.

Handling of the locking spring is also improved. A latching means is provided at least on one of the two first guide surfaces. The latching means cooperate with the openings in the top of the locking part to limit rebound of the locking spring or prevents buckling thereof. The force required to tear the contact out of the chamber is thereby increased.

In various embodiments the latching means may take the form of a channel on the lower edge of a first guide surface or of a hook on a rear edge of a different first guide surface or of a perforation pocket or perforation tongue, which is arranged on the outside of a further first guide surface. The solution using the hook at the lateral edge of the different first guide surface is particularly favourable from a manufacturing perspective.

It is advantageous for the locking spring to have an obtuse-angled first folded portion and an obtuse-angled second folded portion in the area of its front end and for there to be arranged on each side of the obtuse-angled first folded portion a second guide surface folded inwards at right angles. The second guide surface has upper corners bent slightly outwards, which upper corners lie against an inner surface of the top or against an upper side of a side opening in the locking part after latching of the locking spring. The second guide surfaces simplify mounting of the locking spring at the other end thereof. The upper corners effect secure latching thereof in the locking part, wherein latching is reinforced by tensile loading of the locking spring.

An advantageous construction of the invention has an alternate locking spring which has a different obtuse-angled first folded portion, a right-angled second folded portion and an obtuse-angled third folded portion in the area of its different front end. A perforation tongue which is directed towards the connecting part is provided in the obtuse-angled third folded portion. The perforation tongue lies against the different inner surface of a different top of a different locking part after latching of the different locking spring. In this embodiment, the different end of the different locking spring may be produced in a particularly simple manner merely by three folded portions, since the outer edges thereof serve as guide surfaces. In this embodiment, tensile loading of the different locking spring reinforces latching.

In another embodiment, a further locking spring comprises a further obtuse-angled first folded portion, a further right-angled second folded portion and a further obtuse-angled third folded portion in the area of its further front end and in that a further second guide surface folded at right angles is arranged on each side of the further obtuse-angled first folded portion. A free end of the further obtuse-angled third folded portion lies against the further inner surface of a further top of a further locking part after latching-in of the further locking spring. The further second guide surfaces folded at right angles serve simultaneously to fix the locking spring in position in the longitudinal and transverse directions of the pin contact.

It may also be advantageous for the connector tongue to have two halves of arched cross section each with a tip, wherein the two halves adjoin at their edges and are at least pressed and/or welded together at their tips. In this way, the bending strength of the connector tongue is increased and the thickness thereof necessary for good electrical contact is achieved.

BRIEF DESCRIPTION OF THE DRAWINGS

FIG. 3 is a perspective representation obliquely from the rear and above of the pin contact of FIG. 1, with the locking spring mounted in the locking part.

FIG. 13 is a perspective representation obliquely from the rear and above of the second pin contact of FIG. 11, with the second locking spring mounted in the second locking part.

FIG. 23 is a perspective representation obliquely from the rear and above of the third pin contact of FIG. 21, with the third locking spring mounted in the second locking part.

FIG. 25 shows a cross section of the third locking part taken along line D-D of FIG. 24.

FIG. 30 is a view of two stamped blanks for the third pin contact of FIG. 21.

DETAILED DESCRIPTION OF THE PREFERRED EMBODIMENT

Figure 1:
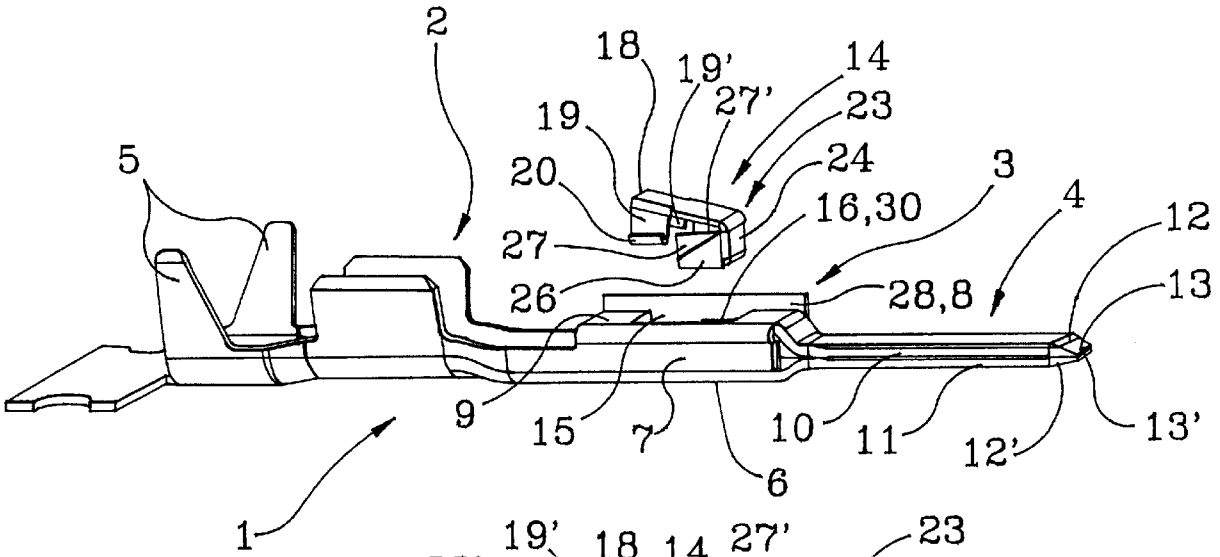
FIG. 1 is a perspective view of a pin contact having a connecting part, a locking part and a connector tongue, a locking spring is exploded from the locking part.
Figure 2:
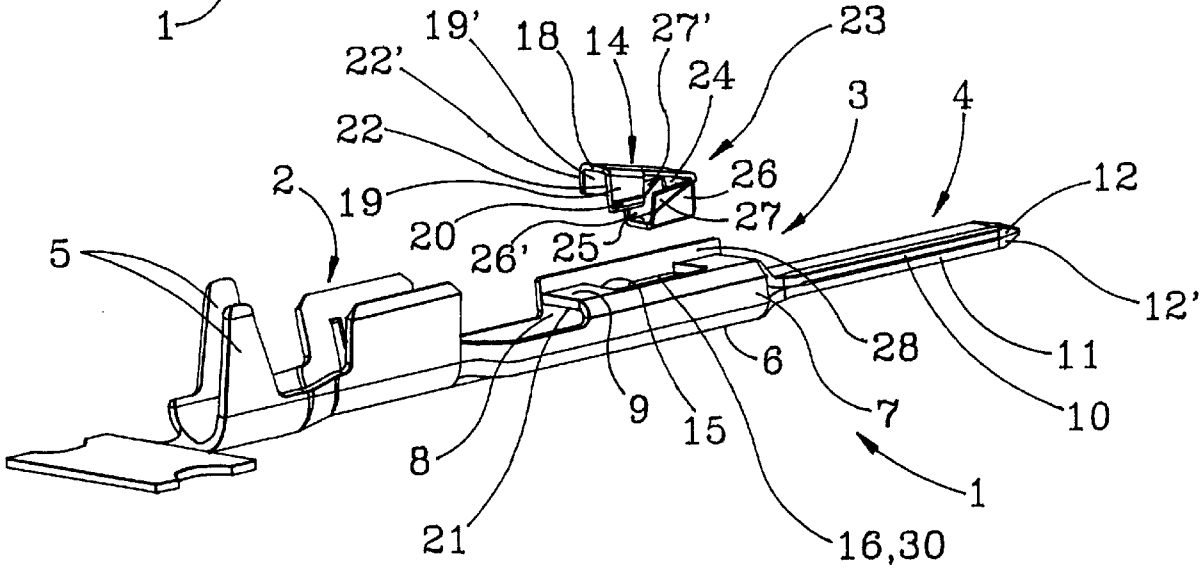
FIG. 2 is a perspective representation obliquely from the rear of the pin contact of FIG. 1, the locking spring is exploded from the locking part.

FIGS. 1 and 2 are perspective views of a pin contact 1. The pin contact 1 serves to connect electrical conductors, not shown. As best shown in FIGS. 1 and 2, pin contact 1 has a connecting part 2, a locking part 3 and a contact part constructed as a connector tongue 4. The connector tongue 4 and the locking part 3 are plugged into a mating counterpart (not shown), in order to produce the desired electrical connection.

A stripped electrical conductor (not shown) is attached in the area of the connecting part 2. In the present example, crimping claws 5 are used for this purpose. However, a soldered connection or a plug part or the like may be used instead.

While the connecting part 2 is open at the top prior to closure of the crimping claws 5, the adjacent locking part 3 exhibits a closed, rectangular box section. A first side wall 7 and a second side wall 8 are folded upwards at right angles from a base 6. A top 9 is folded horizontally from the first side wall 7 and is butt-welded to the second side wall 8. The base 6, the side walls 7 and 8 and the top 9 together form the locking part 3.

One half 10, 11 of the connector tongue 4 is connected with each of the base 6 and the top 9. The halves 10, 11 exhibit arched cross sections, which form a lenticular cavity when the halves 10, 11 are put together. The increased thickness of the connector tongue 4 promotes the rigidity thereof. The tips 12, 12' of the halves 10, 11 are latched and/or welded together by a tongue and groove arrangement.

Above the locking part 3 of FIGS. 1 and 2 there is illustrated a locking spring 14. The locking spring 14 is shown above the locking part 3 for ease of explanation. The locking spring 14 is oriented as if it were mounted in the locking part 3.

A rectangular first opening 15 is provided in the top 9 of locking part 3, through which the locking spring 14 is perpendicularly inserted. In the second side wall 8 there is provided a rectangular side opening 16 with an upper side 30, which serves to latch in the locking spring 14 (see also FIGS. 6 and 8). An extension 28 of the second side wall 8 projecting above the top 9 serves in angular orientation of the pin contact 1 in a counterpart and in protecting the locking spring 14. In the base 6 there is arranged a perforation pocket 17 (FIGS. 4, 5, 6, 7), which is used to fix the locking spring 14 in the longitudinal direction of the locking part 3.

In the area of a rear end 18 of the locking spring 14 there is arranged, on each side thereof, a first guide surface 19, 19' folded at right angles. At the lower edge of the first guide surface 19 there is provided a channel 20, which, when the locking spring 14 is in the installed position, extends parallel to the top 9 and lies against the inner surface 21 thereof. The rear end 18 of the locking spring 14 is thus latched in the locking part 3. The front edges 22, 22' of the first guide surfaces 19, 19' extend perpendicularly to the top 9, whereby the length of the first opening 15 is kept as small as possible.

In the area of the front end 23 of the locking spring 14, an obtuse-angled first folded portion 24 and an obtuse-angled second folded portion 25 are provided. On each side of the obtuse-angled first folded portion 24 there is located a second guide surface 26, 26' folded inwards at right angles and having upper corners 27, 27' bent outwards slightly. These engage in the locking part 3 after mounting of the locking spring 14 and come to lie against the inner surface 21 of the top 9 or against the upper side 30 of the side opening 16 in the second side wall 8. In this way, the front end 23 of the locking spring 14 is also latched in the locking part 3. When the locking spring 14 is subject to tensile load, the latching connection is reinforced by spreading of the bent upper corners 27, 27'.

FIG. 3 shows a perspective representation, obliquely from the rear and above, of the pin contact 1 with an open connecting part 2 and the locking spring 14 mounted in the locking part 3. The protective function of the extension 28 in relation to the locking spring 14 is clear to see. The same applies to the second pin contact 32 in FIG. 13 and the third pin contact 56 in FIG. 23.

Figure 4:
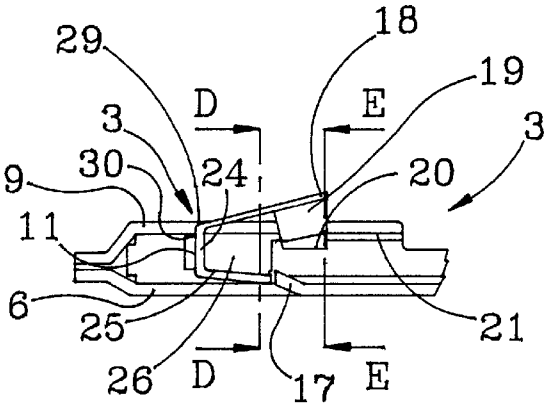
FIG. 4 is a longitudinal section through the locking part of the pin contact of FIG. 1, with the locking spring mounted thereon.

FIG. 4 shows a cross section through the locking part 3 with the locking spring 14 latched or mounted therein. It reveals the top 9 with the first opening 15 for insertion of the locking spring 14 and the base 6 with the perforation pocket 17 as axial limit stop therefor in the direction of the connecting part 2. In the opposite direction, the locking spring 14 rests with its obtuse-angled first folded portion 24 against the narrow side 29 of the first opening 15.

In addition, FIG. 4 also reveals the channel 20 of the first guide surface 19, which lies against the inside 21 of the top 9, and the second guide surface 26, which rests against the upper side 30 of the side opening 16.

Figure 5:
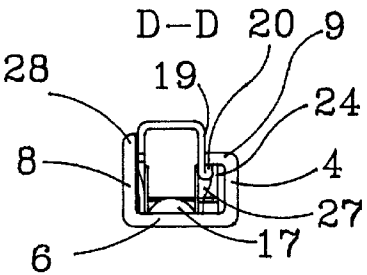
FIG. 5 shows a cross section of the locking part taken along line D-D of FIG. 4.

FIG. 5 shows the first side wall 7, the second side wall 8 with the extension 28, the base 6 and the top 9. Furthermore, the first guide surface 19 is shown, with the channel 20, which, like the upper corner 27, lies against the inner surface 21 of the top 9. The perforation pocket 17 in the base 6 is also visible.

Figure 6:
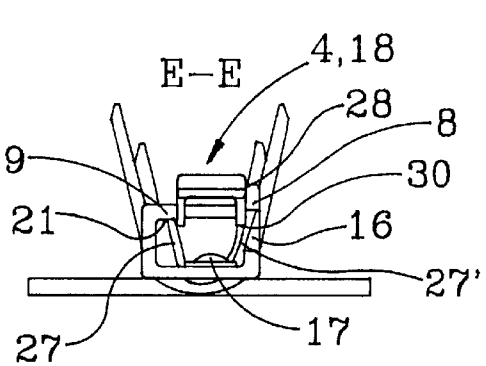
FIG. 6 shows a cross section of the locking part taken along line E-E of FIG. 4.

Referring to FIG. 6, upper corner 27' is positioned in the side window 16 of side wall 8. As shown, the upper corner 27' engages the upper surface 30 of the side window 16. Here too, the perforation pocket 17 may be seen. Also visible is the point where the upper corner 27 lies against the inner surface 21 of the top 9. It is also plain that the corners 27, 27' are spread further when the locking spring 14 is subjected to tensile loading and thereby reinforce the latching connection. Similarly, the protective action of the extension 28 relative to the rear end 18 of the locking spring 14 is visible.

Figure 7:
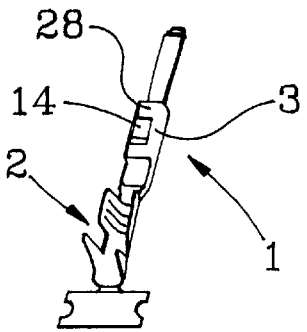
FIG. 7 is a bottom view of the pin contact of FIG. 1.
Figure 7:
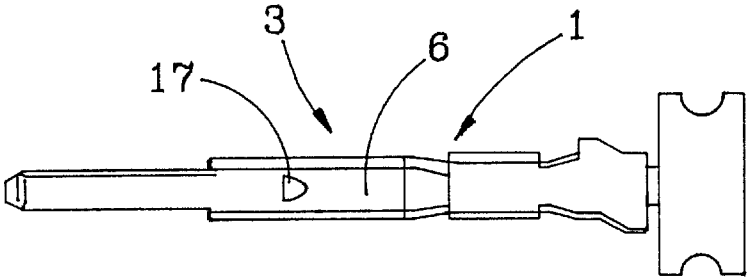

FIG. 7 is a bottom view of the pin contact 1 showing the base 6 of the locking part 3 having the perforation pocket 17 arranged thereon. As previously described, the pocket 17 cooperates with the locking spring 14 to limit the axial movement of the locking spring 14.

Figure 8:
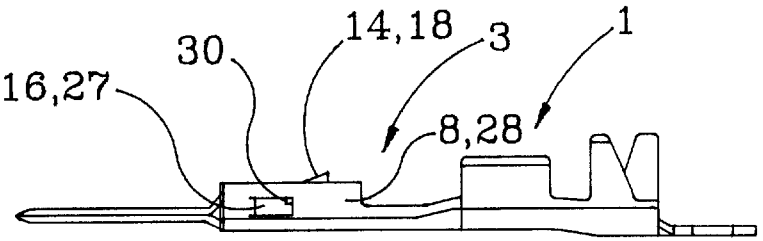
FIG. 8 is a side view of the pin contact of FIG. 1, with the locking spring mounted thereon.

Referring to FIG. 8, the second side wall 8 of the locking part 3 is provided with the side opening 16, the upper side 30 of which engages the upper corner 27'. The end 18 of the locking spring 14 projects only slightly beyond the extension, so that the locking spring 14 is protected, as previously described.

Figure 9:
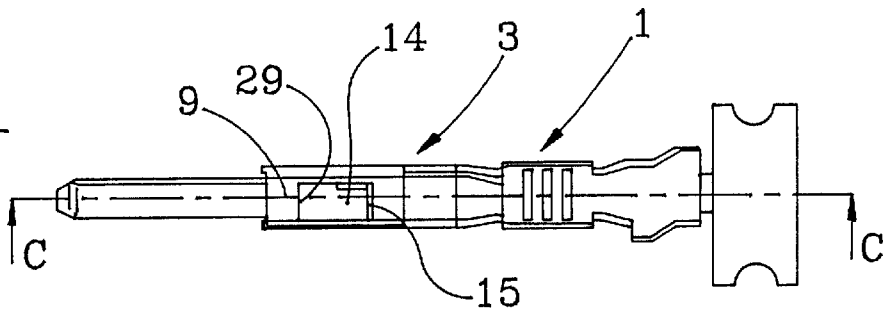
FIG. 9 is a top view of the pin contact of FIG. 1, with the locking spring mounted thereon.

As illustrated in FIG. 9, the first opening 15 of the top 9 of the locking part 3 is confirmed to have the locking spring 14 installed therein. The locking spring 14 engages the narrow side 29 of the first opening 15 thereby allowing the locking spring to pivot or swivel as necessary.

Figure 10:
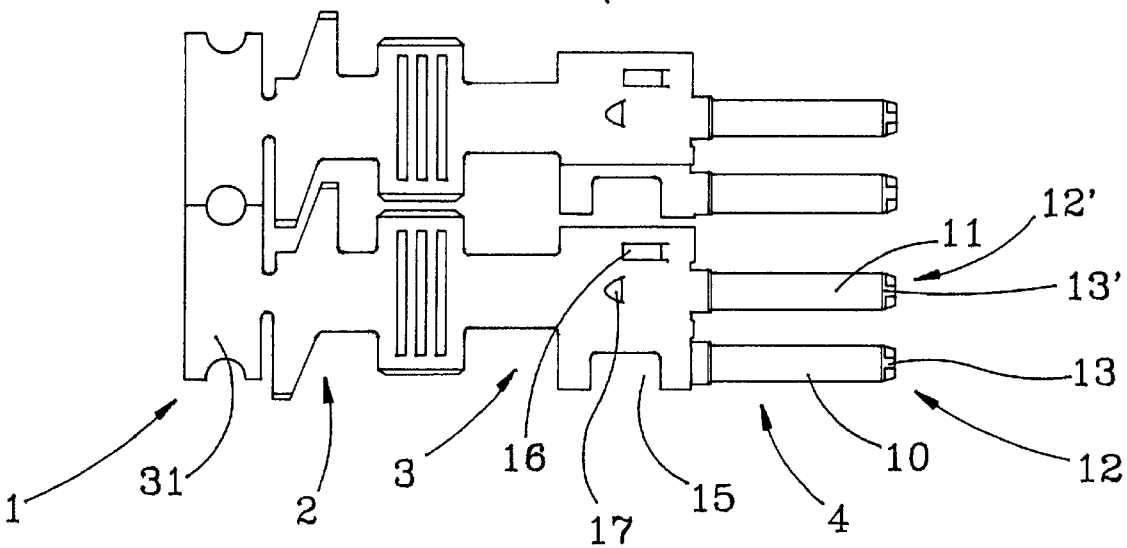
FIG. 10 is a view of two stamped blanks for the pin contact of FIG. 1.

Two stamped or punched blanks for the pin contact 1 are shown in FIG. 10. The blanks are connected by a conveying strip 31 and constitute part of a reelable strip of blanks. The part of the blank strip from which the locking part 3 is formed displays the first opening 15, the side opening 16 and the perforation pocket 17.

The connecting part 2 and the halves 10, 11 of the connector tongue 4 are integrally attached to the locking part 3. At the tip 12 of the upper half 10 of the connector tongue 4 there may be seen a groove 13 and at the tip 12' of the lower half 11 a mating tongue 13', which may be clamped together during assembly of the pin contact 1 and optionally secured by welding. The conveying strip 31 is removed when the connecting part 2 is fitted with a cable.

Figure 11:
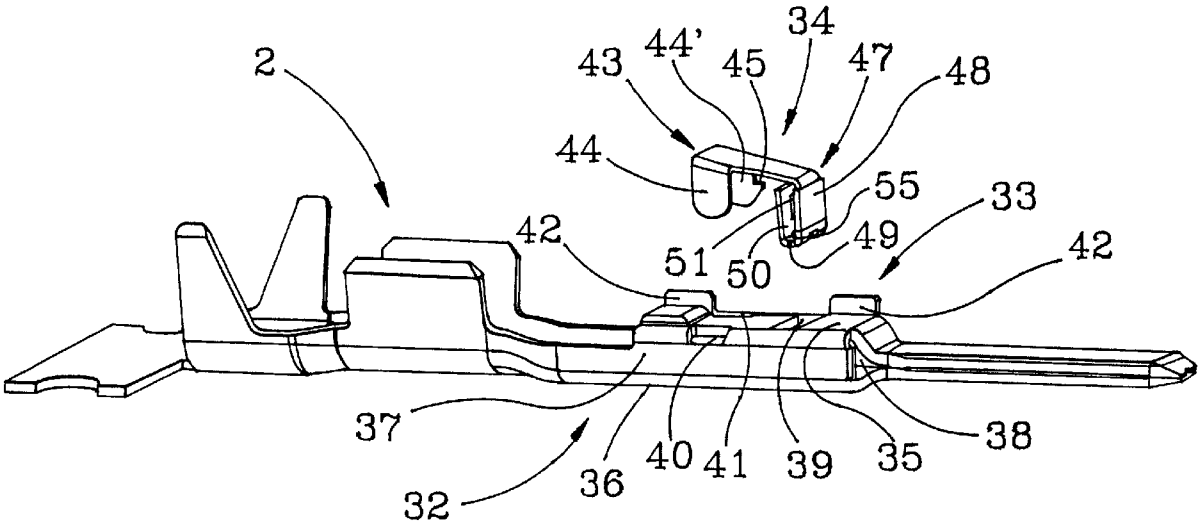
FIG. 11 is a perspective view of a second embodiment of a pin contact having the connecting part, a second locking part and the connector tongue, a second locking spring is exploded from the second locking part.
Figure 12:
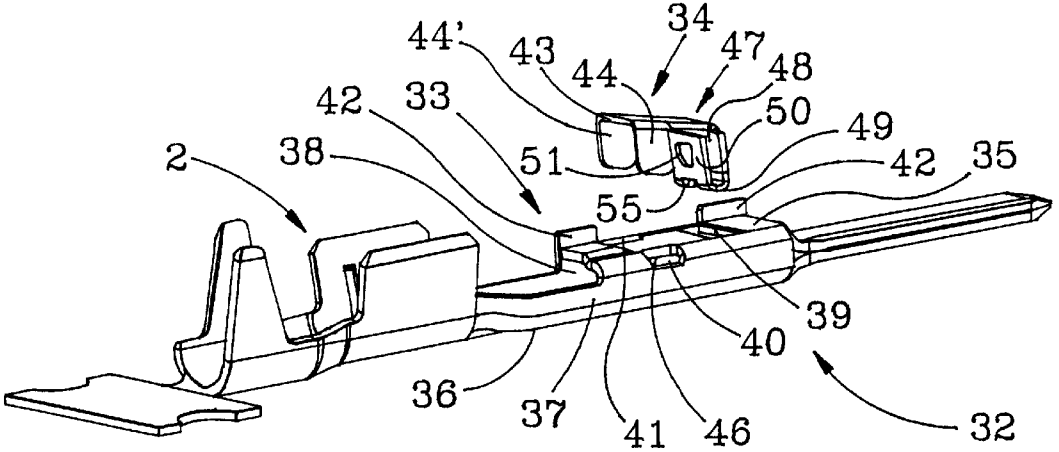
FIG. 12 is a perspective representation obliquely from the rear of the second pin contact of FIG. 11, the second locking spring is exploded from the second locking part.

FIGS. 11 and 12 are perspective views of a second embodiment of the pin contact 32. The locking part 33 and locking spring 34 of the pin contact 32 differ from the locking part 3 and locking spring 14 of the pin contact 1 of FIGS. 1 and 2. Like the locking part 3, the second locking part 33 has a rectangular cross section, with a top 35, a base 36, a first side wall 37 and a second side wall 38.

A first top opening 39, a second top opening 40 and a third top opening 41 are provided in the top 35, the openings are dimensioned to receive the locking spring 34 therein. An extension 42, here of divided construction, is used for angular orientation of the pin contact 32 and for protection of the locking spring 34.

In the area of a rear end 43 of the locking spring 34, there is arranged on each side thereof a first guide surface 44, 44' folded at right angles. At the rear edge of the first guide surface 44' there is provided a hook 45, which, when the locking spring 34 is in the installed position, extends parallel to the top 35 and lies against the inner surface 46 thereof (see also FIG. 14). In this way, the rear end 43 of the locking spring 34 is latched in the locking part 33.

In the area of the front end 47 of the locking spring 34, an obtuse-angled first folded portion 48, a right-angled second folded portion 49 and an obtuse-angled third folded portion 50 are provided. The transition between the first, second and third folded portions is preferably radial. The second folded portion 49 is preferably U-shaped, wherein the U shape exhibits a fixed radius of curvature. In the obtuse-angled third folded portion 50 there is arranged a first perforation tongue 51 directed towards the connecting part 2. The tongue 51 lies against the inner surface 46 of the top 35 of the locking part 33 after the locking spring 34 is latched in position. In this way, the front end 47 of the locking spring 34 is also latched in the locking part 33 and the locking spring 34 is thus secured against unwanted removal. The latching connection is reinforced by spreading of the perforation tongue 51 upon tensile loading of the locking spring 34.

Figure 17:
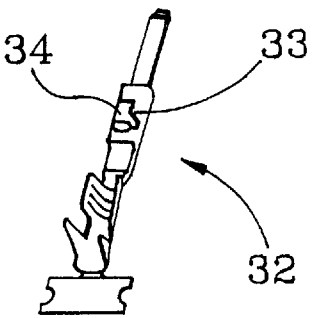
FIG. 17 is a bottom view of the second pin contact of FIG. 11.
Figure 17:
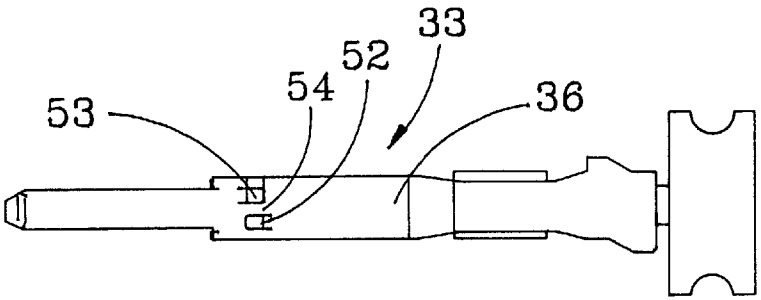
Figure 14:
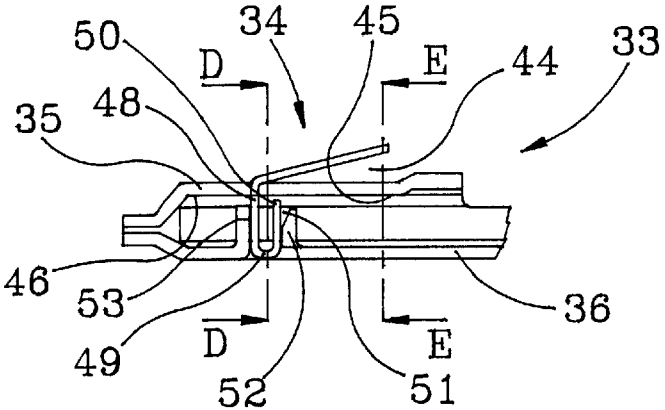
FIG. 14 is a longitudinal section through the second locking part of the second pin contact of FIG. 11, with the second locking spring mounted thereon.

As shown in FIG. 14, second and third perforation tongues 52, 53 are offset laterally in the base 36 and are each bent up and inward by 9020 lengthwise but in opposite directions. The tongues fix the locking spring 34 in the longitudinal direction. The obtuse-angled first and third folded portions 48, 50 are clamped in:between the second and third perforation tongues 52, 53. A web 54 in the base 36 (see FIG. 17) between the second and third perforation tongues 52, 53 serves to provide perpendicular support of the locking spring 34. The right-angled second folded portion 49 of the locking spring 34 has an opening 55 (see also FIGS. 11 and 12) which mates with the web 54.

Figure 15:
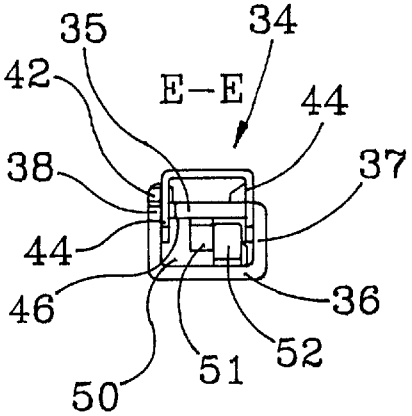
FIG. 15 shows a cross of the second locking part taken along line D-D of FIG. 14.

FIG. 15 shows the second side wall 38 with the extension 42, the first side wall 37, the top 35 with the inner surface 46 and the base 36 with the second perforation tongue 52. The components of the locking spring 34 which are visible are the first guide surfaces 44, 44' and the obtuse-angled third folded portion 50 with the first perforation tongue 51. The latter lies against the inner surface 46 of the top 35 when the locking spring 34 is in the mounted state.

Figure 16:
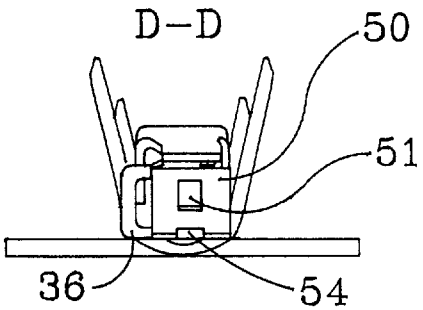
FIG. 16 shows a cross section of the second locking part taken along line E-E of FIG. 14.

FIG. 16 shows the third obtuse-angled folded portion 50 with the first perforation tongue 51 and the base 36 with the web 54.

Figure 18:
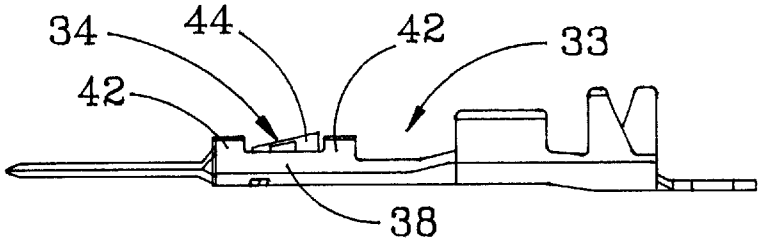
FIG. 18 is a side view of the second pin contact of FIG. 11, with the second locking spring mounted thereon.

FIG. 18 shows a side view of the different locking part 33 with the second side wall 38 and the extension 42 thereof, which serve in orienting the pin contact 32 and in protecting the locking spring 33. The first guide surface 44' thereof is likewise illustrated.

Figure 19:
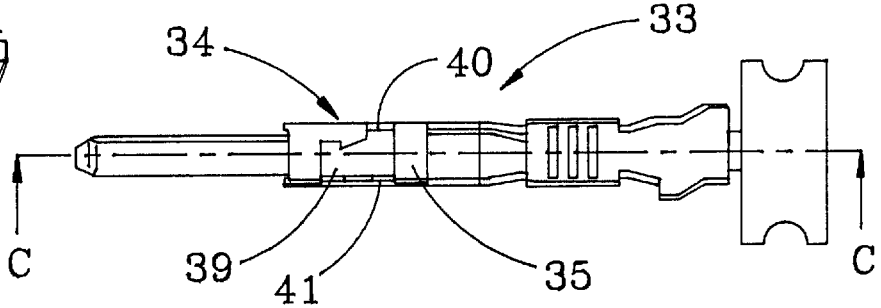
FIG. 19 is a top view of the second pin contact of FIG. 11, with the second locking spring mounted thereon.

FIG. 19 shows a top view of the pin contact 32, with the locking spring 34, which engages in the first, second and third top openings 39, 40, 41 of the top 35 of the different locking part 33.

Figure 20:
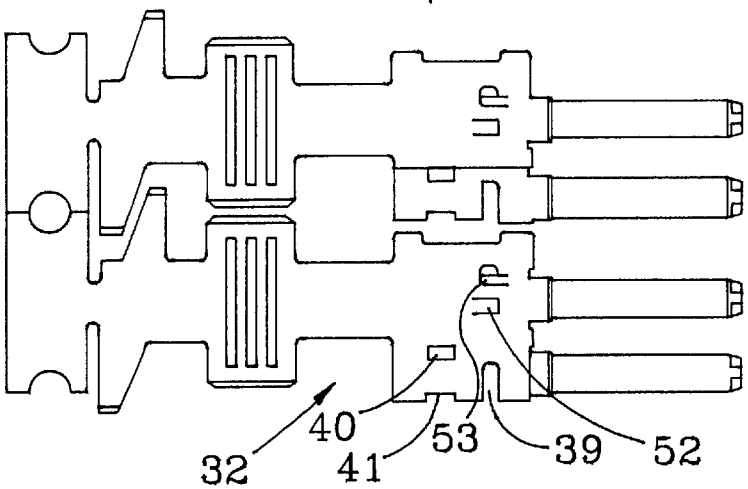
FIG. 20 is a view of two stamped blanks for the second pin contact of FIG. 11.

Two stamped or punched blanks for the pin contact 32 are shown in FIG. 20. The figure shows the second and third perforation tongues 52, 53 and the first, second and third top openings 39, 40, 41.

Figure 21:
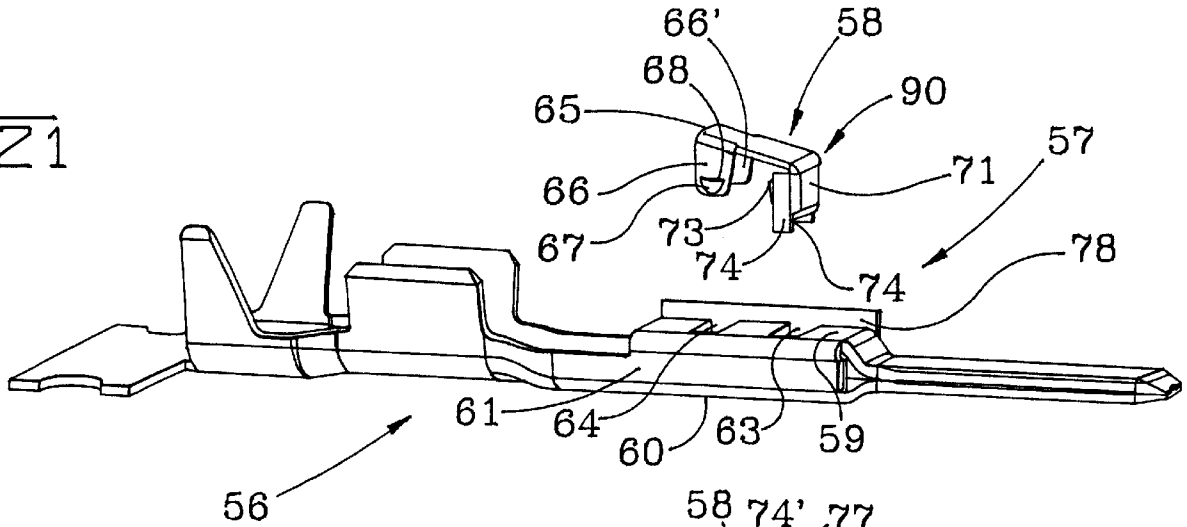
FIG. 21 is a perspective view of a third embodiment of a pin contact having the connecting part, a third locking part and the connector tongue, third locking spring is exploded from the third locking part.
Figure 22:
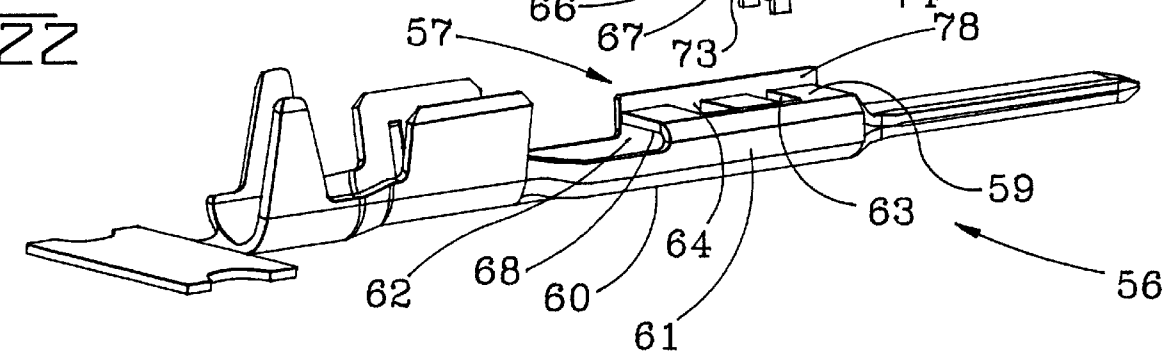
FIG. 22 is a perspective representation obliquely from the rear of the third pin contact of FIG. 21, the third locking spring is exploded from the third locking part.

FIGS. 21 and 22 show a third pin contact 56, again in perspective positions. It differs from the pin contact 1 and the second pin contact 32 by a modified third locking part 57 and a modified third locking spring 58.

The locking part 57 again exhibits a rectangular cross section, with a top 59, a base 60, a first side wall 61 and a second side wall 62 with an extension 78.

A first top opening 63 and a second top opening 64 are provided in the top 59, which openings are dimensioned to receive the locking spring 58.

In the area of a rear end 65 of the locking spring 58, there is provided on each side thereof a first guide surface 66, 66' folded at right angles. At the rear surface of the first guide surface 66 there is arranged a perforation pocket 67, the edge 68 of which lies against an inner surface 69 of the top 59 after mounting of the locking spring 58 (see also FIG. 24). In this way, the rear end 65 of the locking spring 58 is latched in the locking part 57.

In the area of a front end 70 of the locking spring 58, an obtuse-angled first folded portion 71, a further right-angled second folded portion 72 (see FIG. 24) and a further obtuse-angled third folded portion 73 are provided.

Two guide surfaces 74, 74' are folded back on both sides of the obtuse-angled first folded portion 71, these being inwardly directed, parallel and rectangular. They project downwards beyond the right-angled, second folded portion 72 and engage, when the locking spring 58 is in the mounted state, in first and second base openings 75, 76 in the base 60 (see FIG. 27) as well as in the first top opening 63 and serve to fix the locking spring 58 in the longitudinal direction.

Figure 24:
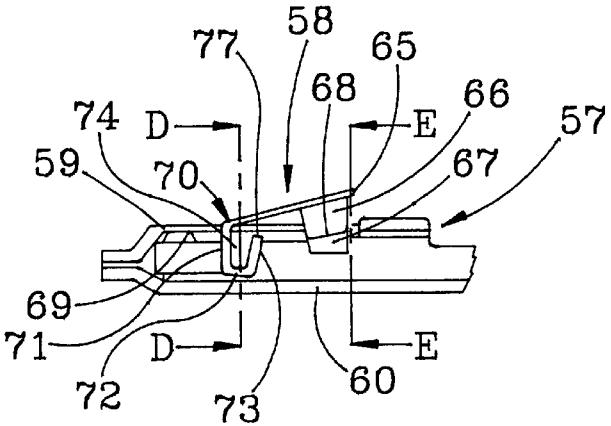
FIG. 24 is a longitudinal section through the third locking part of the third pin contact of FIG. 21, with the third locking spring mounted thereon.
Figure 27:
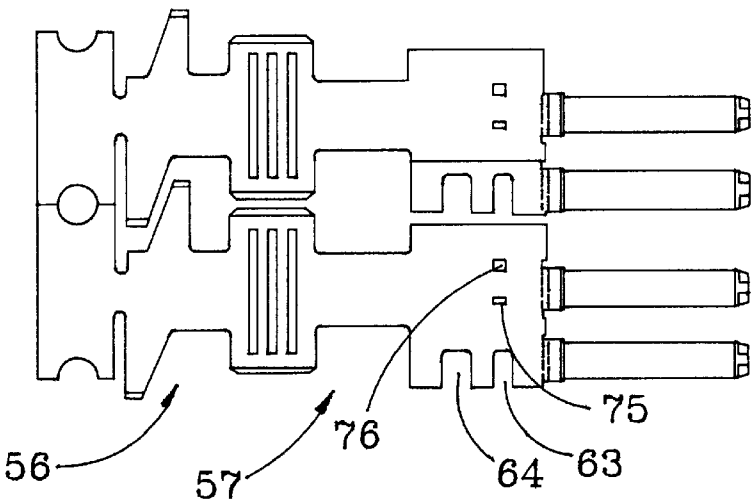
Figure 70:
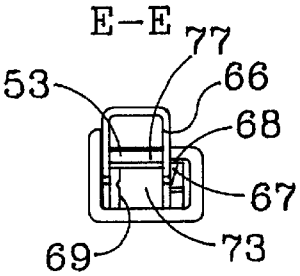

FIG. 24 illustrates that, after mounting of the locking spring 58, the free end 77 of the obtuse-angled third folded portion 73 latches in beneath the top 59 and lies against the inner surface 69 thereof, while the right-angled second folded portion 72 lies against the base 60. In this way, vertical fixing of the locking spring 58 is ensured and unwanted removal is prevented.

Figure 26:
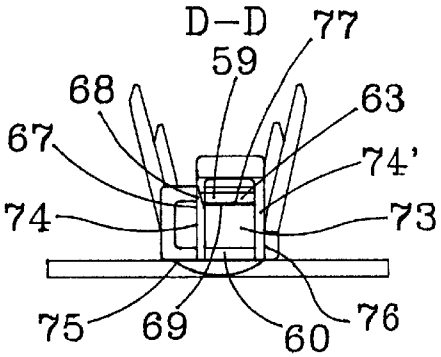
FIG. 26 shows a cross of the third locking part, taken along line E-E of FIG. 24.

As is shown in FIG. 25 and FIG. 26, the edge 68 of the perforation pocket 67 of the first guide surface 66 and the free end 77 of the obtuse-angled third folded portion 73 lie against the inner surface 69 of the top 59 when the locking spring 58 is in the mounted state and thereby effect latching thereof in the locking part 57.

FIG. 26 also shows the second guide surfaces 74, 74', which engage in the first and second base openings 75, 76 of the base 60 and in the first top opening 63 of the top 59.

Figure 27:
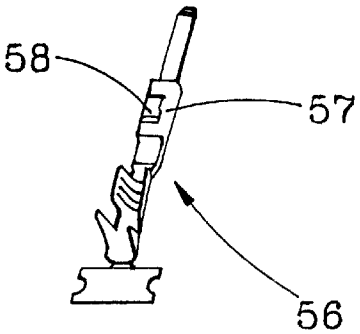
FIG. 27 is a bottom view of the third pin contact of FIG. 21.
Figure 27:
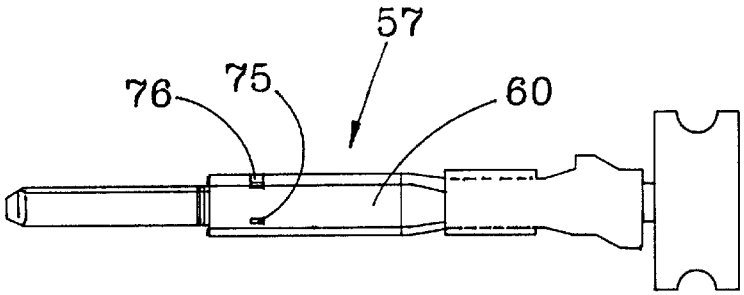

The bottom view of FIG. 27 shows the first and second base openings 75, 76 in the base 60 of the locking part 57.

Figure 28:
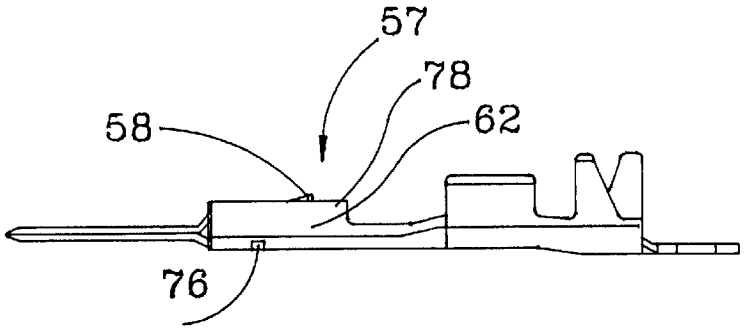
FIG. 28 is a side view of the third pin contact of FIG. 21, with the third locking spring mounted thereon.

The side view of FIG. 28 shows the second side wall 62 with the extension 78 and the second base opening 76 in the locking part 57 together with the locking spring 58, which is extensively hidden by the protective extension 78.

Figure 29:
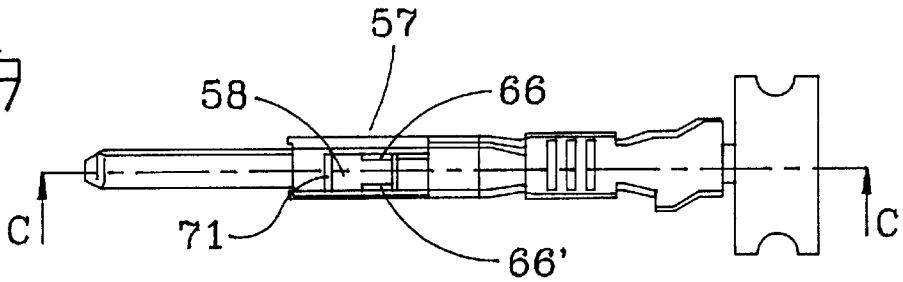
FIG. 29 is a top view of the third pin contact of FIG. 21, with the third locking spring mounted thereon.

The plan view of FIG. 29 shows the locking part 57 with the locking spring 58 and the indicated obtuse-angled first folded portion 71 thereof together with the first guide surfaces 66, 66'.

The punched blanks for the pin contact 56 illustrated in FIG. 30 show the locking part 57 with the first and second base openings 75, 76 and with the first and second top openings 63, 64 prior to forming.

In conclusion it may be stated that the pin contacts 1, 32, 56 are functionally reliable and simple to manufacture and assemble.

We claim:

1. An electrical pin contact comprising:

a connecting part and a connector tongue together with a locking part;

a separate locking spring for insertion into the locking part perpendicular to the longitudinal axis of the contact;

the locking spring has latching means, the latching means directly fix the locking spring in the locking part such that only insertion of the locking spring into the locking part is required to directly fix the locking spring therein, the locking part has openings adapted to receive and latch the locking spring in the locking part, the locking spring has guide surfaces and latching means at the ends thereof, a rear guide surface is folded at right angles and is arranged in the area of a rear end of the locking spring on each side thereof; and the latching means is a channel on a lower edge of the rear guide surface, the latching means is provided at least at one of the two rear guide surfaces, the latching means cooperates with the openings in the top of the locking part to limit movement of the locking spring and to prevent buckling thereof.

2. The contact according to claim 1 wherein the locking spring has an obtuse-angled first folded portion and an obtuse-angled second folded portion in the area of its front end, on each side of the obtuse-angled first folded portion there is arranged a second guide surface folded inwards at right angles and having upper corners bent slightly outwards, the upper corners lie against an upper side of a side opening in the locking part after latching of the locking spring.

3. The contact according to claim 1 wherein the locking spring has an obtuse-angled first folded portion, a second folded portion and an obtuse-angled third folded portion in the area of its front end, a first perforation tongue directed towards the connecting part is provided in the obtuse-angled third folded portion, the perforation tongue lies against the inner surface of the top of the different locking part after latching of the locking spring.

4. The contact according to claim 1 wherein the locking spring has an obtuse-angled first folded portion, a right-angled second folded portion and an obtuse-angled third folded portion in the area of its front end, a second guide surface folded at right angles is arranged on each side of the obtuse-angled first folded portion and a free end of the obtuse-angled third folded portion lies against an inner surface of the top of the locking part after latching of the locking spring.

5. The contact according to claim 1 wherein the locking spring has an obtuse-angled first folded portion and an obtuse-angled second folded portion in the area of its front end, on each side of the obtuse-angled first folded portion there is arranged a second guide surface folded inwards at right angles and having upper corners bent slightly outwards, the upper corners lie against an inner surface of the top.

6. The contact according to claim 5 wherein the connector tongue has two halves of arched cross section each with a tip such that the two halves adjoin only at their edges and are latched together at their tips.

7. An electrical pin contact comprising:

a connecting part and a connector tongue together with a locking part;

a separate locking spring for insertion into the locking part perpendicular to the longitudinal axis of the contact;

the locking spring has latching means, the latching means directly fix the locking spring in the locking part such that only insertion of the locking spring into the locking part is required to directly fix the locking spring therein, the locking part has openings adapted to receive and latch the locking spring in the locking part, the locking spring has guide surfaces and latching means at the ends thereof, a rear guide surface is folded at right angles and is arranged in the area of a rear end of the locking spring on each side thereof; and the latching means is a hook on an edge of a respective guide surface, the latching means is provided at least at one of the two rear guide surfaces, the latching means cooperates with the openings in the top of the locking part to limit movement of the locking spring and to prevent buckling thereof.

8. An electrical pin contact comprising:

a connecting part and a connector tongue together with a locking part;

a separate locking spring for insertion into the locking part perpendicular to the longitudinal axis of the contact;

the locking spring has latching means, the latching means directly fix the locking spring in the locking part such that only insertion of the locking spring into the locking part is required to directly fix the locking spring therein, the locking part has openings adapted to receive and latch the locking spring in the locking part, the locking spring has guide surfaces and latching means at the ends thereof, a rear guide surface is folded at right angles and is arranged in the area of a rear end of the locking spring on each side thereof; and the latching means is a perforation tongue which is provided on the outside of a respective first guide surface, the latching means is provided at least at one of the two rear guide surfaces, the latching means cooperates with the openings in the top of the locking part to limit movement of the locking spring and to prevent buckling thereof.

9. An electrical pin contact comprising:

a connecting part and a connector tongue together with a locking part;

a separate locking spring for insertion into the locking part perpendicularly to the longitudinal axis of the contact;

the locking spring has latching means which fix the locking spring in position in the locking part through insertion of the locking spring into the locking part, the latching means is a channel on a lower edge of a rear guide surface.

10. The contact according to claim 9 wherein the locking spring has an obtuse-angled first folded portion and an obtuse-angled second folded portion in the area of its front end, on each side of the obtuse-angled first folded portion there is arranged a second guide surface folded inwards at right angles and having upper corners bent slightly outwards, the upper corners lie against an upper side of a side opening in the locking part after latching of the locking spring.

11. The contact according to claim 9 wherein the locking spring has an obtuse-angled first folded portion, a second folded portion and an obtuse-angled third folded portion in the area of its front end, a first perforation tongue directed towards the connecting part is provided in the obtuse-angled third folded portion, the perforation tongue lies against the inner surface of the top of the different locking part after latching of the locking spring.

12. The contact according to claim 9 wherein the locking spring has an obtuse-angled first folded portion, a right-angled second folded portion and an obtuse-angled third folded portion in the area of its front end, a second guide surface folded at right angles is arranged on each side of the obtuse-angled first folded portion and a free end of the obtuse-angled third folded portion lies against an inner surface of the top of the locking part after latching of the locking spring.

13. The contact according to claim 9 wherein the locking spring has an obtuse-angled first folded portion and an obtuse-angled second folded portion in the area of its front end, on each side of the obtuse-angled first folded portion there is arranged a second guide surface folded inwards at right angles and having upper corners bent slightly outwards, the upper corners lie against an inner surface of the top.

14. The contact according to claim 13 wherein the connector tongue has two halves of arched cross section each with a tip such that the two halves adjoin only at their edges and are latched together at their tips.

* * * * *